United States Patent [19]

Chambley et al.

[11] 4,074,511

[45] Feb. 21, 1978

[54] SELF TWIST YARN STRAND SYSTEM

[75] Inventors: Phillip W. Chambley; Alan H. Norris, both of Rome, Ga.

[73] Assignee: Champion International Corporation, Stamford, Conn.

[21] Appl. No.: 755,671

[22] Filed: Dec. 30, 1976

[51] Int. Cl.[2] ..... D01H 7/90

[52] U.S. Cl. ..... 57/34 AT; 57/106

[58] Field of Search ..... 57/34 AT, 106, 34 HS

[56] References Cited

U.S. PATENT DOCUMENTS

| | | | |
|---|---|---|---|
| 3,225,533 | 12/1965 | Henshaw | 57/34 AT |
| 3,434,275 | 3/1969 | Backer et al. | 57/34 AT |
| 3,537,251 | 11/1970 | Kimura et al. | 57/34 AT X |
| 3,717,988 | 2/1973 | Walls | 57/34 AT |

*Primary Examiner*—Richard C. Queisser
*Assistant Examiner*—Charles Gorenstein
*Attorney, Agent, or Firm*—Roylance, Abrams, Berdo & Kaul

[57] ABSTRACT

Self-twist plural yarn strands are produced by a system wherein at least two singles yarn strands are individually twisted to form twisted strands each having longitudinally spaced nodes, and strands are brought together in a parallel relationship with the nodes of one strand substantially aligned with the nodes of each other strand. The corresponding nodes from one strand are fastened to those of each other strand, and the strands are allowed to ply. The node fastening means comprises a rotating member having a contact surface for fastening the nodes by gathering and twisting of the fibers from one strand with those of another strand at the nodes of each respective strand. Ply yarn twist uniformity is assured through the use of improved twist insertion jets, together with a means for holding singles yarns separate to allow longitudinal levelling of singles yarn torque prior to plying.

13 Claims, 11 Drawing Figures

SELF TWIST YARN STRAND SYSTEM

This invention relates to an improved process and apparatus for forming yarn of the self-twist type, and the yarn product produced thereby.

In the manufacture of yarn, particularly yarn from synthetic fibers, there have been substantial developments in the area of false-twist and self-twist yarns because of various production advantages which can be realized using these techniques, and because such processes provide a shortened manufacturing route to a finished yarn product, and are therefore more economical as compared with conventional spinning and twisting processes.

As used herein, the term "false-twist" refers to a yarn in which a yarn strand is twisted at some intermediate point generating opposite twists on either side of the twist insertion device, with the point at which the device is located containing zero twist, which point will be referred to as a "node". The directions of twist are referred to as "S-twist" or "Z-twist", the appropriate letter being employed for twists in which the helices in twisted strands correspond with the middle portion of the appropriate letter.

The term "self-twist" is applied to yarns wherein two or more false twisted strands are brought together and permitted to ply themselves. The approximately equal torsional force of the same direction is stored in a pair or more of singles yarns which are later brought into contact. Torque is released, permitting the single yarns to untwist, and in so doing, wrap around each other, forming a plied yarn.

Generally speaking, false-twisting and self-twisting and the yarns produced thereby have received considerable attention in recent years and reference is made to the following documents in which these yarns, the techniques for producing them, and specific apparatus related thereto are discussed:

"Self-Twist Yarn," D. E. Henshaw, Merrow Publishing Co. Ltd., Watford, Herts, England, 1971.

U.S. Pat. No. Re. 27,717 — Breen et al

U.S. Pat. No. 3,225,533 — Henshaw

U.S. Pat. No. 3,306,023 — Henshaw et al

U.S. Pat. No. 3,353,344 — Clendening, Jr.

U.S. Pat. No. 3,434,275 — Backer et al

U.S. Pat. No. 3,507,108 — Yoshimura et al

U.S. Pat. No. 3,717,988 — Walls

U.S. Pat. No. 3,775,955 — Shah

U.S. Pat. No. 3,940,917 — Strachan

While this is by no means an exhaustive listing of patents or literature references on this subject, the foregoing represent references which discuss the principles and techniques which are part of the prior art.

As will be recognized from these and other references relating to this art, there are a number of problems inherent in producing yarn using self-twist techniques, these problems being related in part to the fact that the yarn tends to be relatively unstable due to the different twists in singles being able to cancel each other through the node area. In this regard, the above-cited U.S. Pat. No. 3,434,275, to Backer et al suggests joining regions of twist reversal. Also, in the production of self-twist yarn, the yarn tension and other parameters involved in the production are highly critical and must be closely controlled.

An object of the present invention is to provide a unique apparatus for fixing or locking yarn at the node points.

A further object of the present invention is to provide a node fixation apparatus in which doffing from the fixation apparatus is reliably and uniformly controlled.

Another object is to provide an apparatus for reliably controlling the degree and direction of twist to form self-twist yarns.

Another object is to provide means for assuring improved uniformity of ply twist in the finished yarn.

Yet another object is to provide an apparatus in which self-twisted yarn is produced and then heat set to hold the yarn in the desired characteristic plied structure.

Briefly described, the invention includes an apparatus for forming a self-twist plural strand yarn comprising means for forming two or more singles yarn strands, means for twisting each of said strands individually to form false-twisted strands each having longitudinally spaced nodes at which the direction of twist reverses, means for guiding the strands into closely spaced substantially parallel paths with the nodes of one strand substantially aligned with the nodes of the other strand, and means for fastening together each of the strands at the nodes, and self-twist plying of the strands between the nodes, either before or after the node fixation takes place, with the preferred method being to fasten the nodes while holding the singles yarns separate to permit redistribution and levelling of stored torques for more uniform ply twist, and wherein the means for guiding includes a rotatable guide member, and the means for node fixation includes rotating contact surface means carried by the means for guiding, the contact surface means being exposed to said parallel paths at spaced intervals for abrading said strands preferably at the regions of said nodes.

The terms "node fixation" and "node fastening" are interchangeably used herein to mean a process for contacting two or more adjacent singles node areas with a rapidly rotating contact surface so as to gather fibers from each of the yarns and twist them together thereby "fixing" or "locking" the nodes, and thus preventng rotation of the singles yarns. Such node fixation permanently preserves the singled twist, since the singles twists that are in opposite directions on either side of the nodes cannot "see" or "reach" each other and cancel through the fastened node.

The rapidly rotating contact surface may vary in texture depending upon the nature of the particular yarn being fastened. Thus, such surface may be relatively coarse, e.g., 30 to 100 grit, or may be relatively smooth, e.g., hard rubber or polyurethane, which surface may be treated with a material in order to increase the frictional properties of the contact surface. Additionally, the contact surface may be composed of closely spaced wire pins or bristles. In general, any form of contact surface may be used which, when rotated, serves to fasten the nodes by locking the yarn fibers of adjacent nodes together when brought into contact therewith.

The axis of the rotating fixation device is substantially perpendicular to the axis of the yarn being treated.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
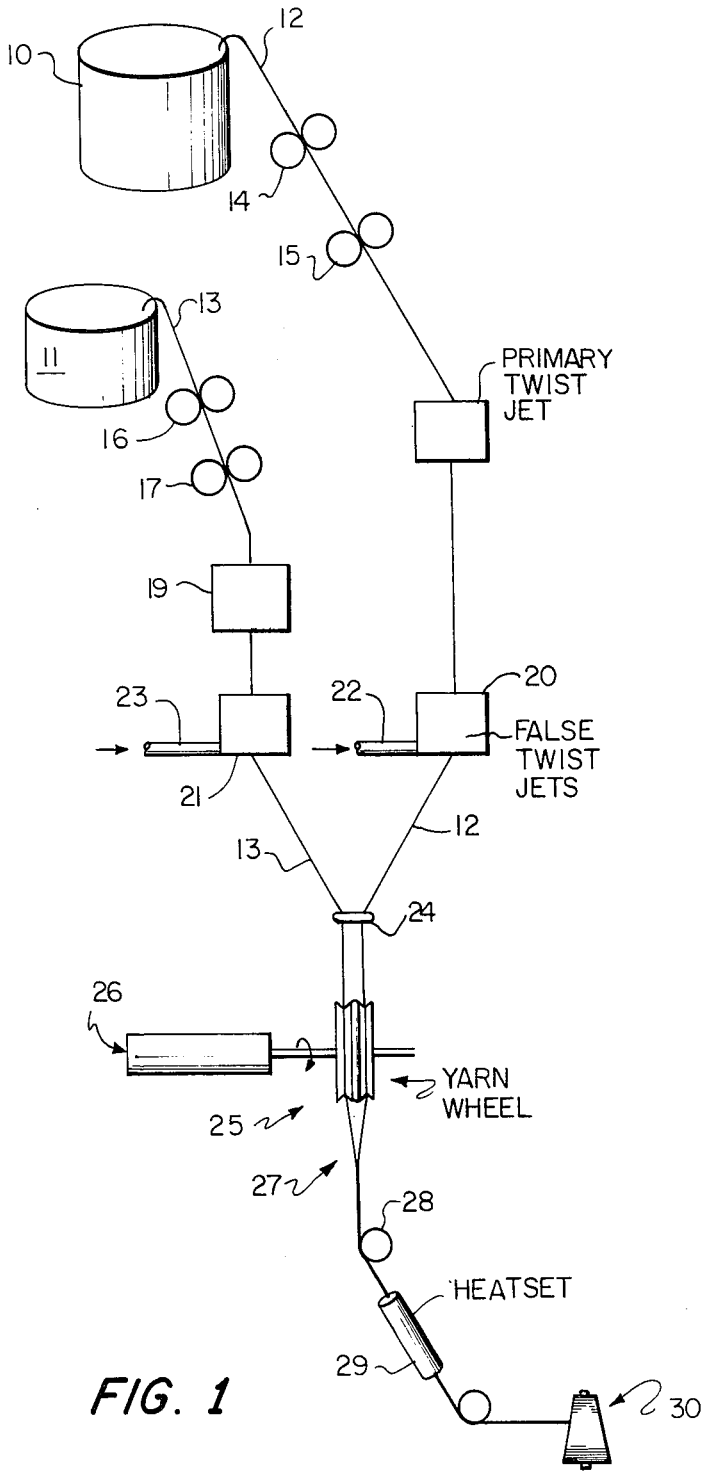
FIG. 1 is a schematic diagram of a system for forming self-twisted yarns employing apparatus according to the present invention.

As shown in FIG. 1, the system will be described commencing with the yarn strands being withdrawn from sliver containers 10 and 11, the yarn strands 12 and 13 being subjected to a drafting or drawing process by pulling the yarns between drafting rolls, yarn 12 being drawn by drafting rolls 14 and 15 and yarn 13 being drawn by rolls 16 and 17. Roll 15 typically is driven at a surface velocity greater than that of roll 14 and roll 17 is driven at a surface velocity greater than roll 16. The yarns can then be passed through primary twist jets, yarn 12 being passed through primary twist jet 18 and yarn 13 being drawn through primary twist jet 19. The primary twist jets operate to impart and maintain twist at the critical point where the otherwise flat sliver ribbon leaves the draft delivery rolls. Yarn strand 12 is passed through a singles-twist jet 20 and yarn 19 is passed through a singles-twist jet 21 wherein the twist is inserted in the yarn strands. Air pressure under the control of apparatus not shown is supplied to jets 20 and 21 through conduits 22 and 23, respectively.

Such control apparatus may be fluidic valves, electrical valves or mechanically operated valves, such apparatus being conventionally available. An example thereof is to be found at page 30 of the previously cited Henshaw text, "Self Twist Yarn," in FIG. 3.8(*b*). It should be noted at this stage that jets 20 and 21 are paired to twist the yarn strands in the same direction as each other and are operated to periodically reverse the direction of twist to result in a yarn wherein there are opposite senses of twist separated by short nodes of zero twist, which nodes are in synchronization with the yarn wheel which bears the fixation device, so that the nodes appear at the surface of the fixation disc. Thus, yarn strands 12 and 13 emerge from jets 20 and 21 with alternating S and Z portions of twist therein.

The strands are passed through opposite sides of a generally elongated wire guide 24 which assists in maintaining the singles twist in the yarn strands and serves the purpose of bringing the yarns into a relatively closely spaced relationship, preferrably not in contact with each other. The yarns are guided onto a yarn wheel indicated generally at 25, the details of which will be described hereinafter. Yarn wheel 25 serves the function of guiding the yarns in parallel spaced relationship with each other, fixing the yarns at their nodes by means of a rotating fixation device, hereinafter described in greater detail, along with appropriate guides.

As previously suggested, yarns which are twisted, brought together and allowed to ply immediately upon leaving the singles yarn twist-insertion apparatus exhibit non-uniform twist distribution in the plied yarn. Generally, the twist is tighter just after the twist direction change, i.e., the node, and then begins to decrease with increased distance from the node. In some cases, a distinct loss of twist has been observed just prior to the direction change node.

The tight twist presence preceding the node can be attributed to feed-through of backed up twist from behind the insertion device when the twist direction change occurs. Because the ply twist is the result of the release of forces stored in the singles twist, the twist non-uniformity in the plied yarn is apparently caused by non-uniformity of the singles twist. This is partly the result of the process of the singles yarn in one direction, generating, for example, a Z twist above the jet and an S jet twist below the jet, and then reversing the direction of the jet so that, at the instant of the switch from Z to S ply mode, the jet permits the leading end of the upstream Z singles twist to pass through to a position below the jet. After reversal, the jet further inserts Z twist below the jet in a portion of the yarn which already has some Z twist, thereby causing that portion adjacent the node to be more tightly twisted than the following yarn.

This is also true when the twist is in the opposite direction.

Clearly, there are differences in stored torque along the length of twist between the nodes. The yarn cross-sectional areas (fibers per cross-section) are equal or nearly equal. Since one portion is twisted tighter than other portions, it has greater stored torque and therefore a greater tendency to untwist than the other portions.

If, however, two longitudinally adjacent nodes are held in a fixed position in a single yarn and the yarn in between is not confined or restrained, the non-uniform twist will distribute itself along that length, the result being a more equal distribution of twist between nodes. By locking the yarn at the nodes to an adjacent yarn prior to permitting the self-twist or plying to occur, it is possible to accomplish the equivalent of holding the nodes while guiding a portion of the yarn around the yarn wheel but keeping the singles yarns apart, thereby permitting this distribution to occur before two adjacent singles yarns are allowed to ply together. Such method produces yarn of a much greater uniformity of twist along the distance spanning two adjacent longitudinal nodes than is possible by a process which provides no means for holding singles yarns separate to allow such "leveling" of singles twist to occur, e.g., by locking the nodes after the ply twist has developed. Because the two strands of yarn do not ply until they leave the wheel surface, as indicated generally at 27 in FIG. 1, the singles yarns are able to self-adjust any variations in torque between nodes by slippage on the wheel surface in the direction of rotation about their own axes, thereby equalizing the twist distribution.

It will be observed that yarn twist cannot be equalized after plying because each cross-section in a self-twist yarn has reached a torque balance between the ply and singles twist. Once this balance occurs, no further axial rotation can occur.

As will be described hereinafter, the yarn wheel is provided with a fixation means to affect locking of the nodes and the wheel is driven by a drive and control device indicated generally at 26 in synchronism with the delivery speed of the yarn and the control apparatus controlling jets 20 and 21 so that the nodes are contacted by the fixation disc on the yarn wheel.

After joining, the plied yarn is guided around a doffer roll 28 and wound or taken up by other appropriate means, or may be first passed through the continuous heat-setting apparatus indicated schematically at 29 prior to take up. Doffer roll 28 may be, for example, a turned metal wheel with a knurled or emery surface, so that is assures removal of the plied yarn from contact with the fixation device. Finally, the yarn can then be stored for future use as indicated at 30.

Figure 2:
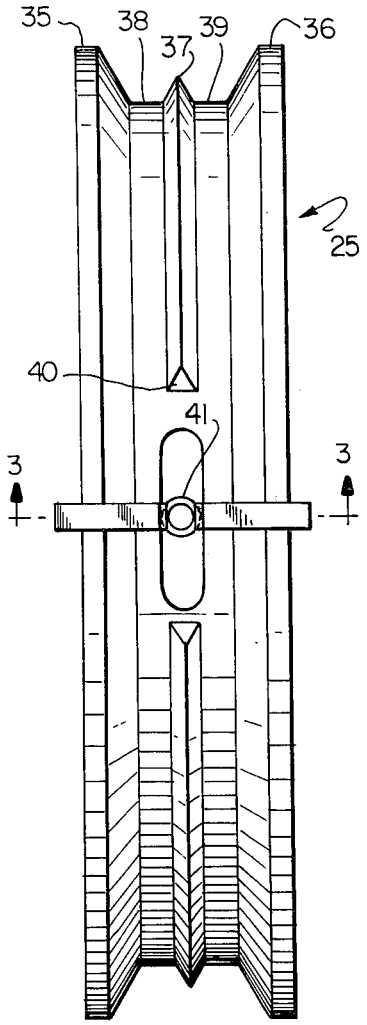
FIG. 2 is a front elevation of a yarn wheel including guide means and node fixation means in accordance with the present invention.

A first embodiment of a yarn wheel including guide means and node fixation means is indicated generally at 25 in FIG. 2. As shown therein, the wheel may be a generally disc-shaped member having flanges 35 and 36 at the axial limits thereof and a central, separatory flange 37, the three flanges defining peripheral surface portions 38 and 39 along which yarn strands can be separately guided. Although wheel 25 is shown as having a single central, separatory flange 37, additional separatory flanges may be provided depending on the number of singles yarns being plied. The number of separatory flanges will always be one less than the number of singles yarns being plied. Central flange 37 is interrupted at 40 to permit the strands to come into close proximity with each other and also to come in contact with the contacting surface of the fixation device, e.g., an abrasion disc 41 which is rotating about an axis generally perpendicular to the axis of rotation of the yarn wheel and at a relatively high speed, on the order of 8,000 rpms. Typically, the disc can be driven by an electric motor which is mounted in the yarn wheel and to which D.C. voltage is supplied by means of a brush and slip ring combination which will be described with reference to FIG. 5. Regardless of the number of separatory flanges 37 utilized, each singles yarn must be brought into contact with every other singles yarn on the disc 41 by suitable channeling means.

Figure 3:
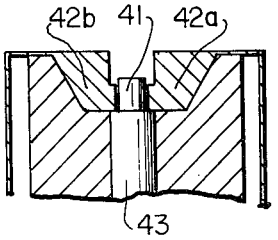
FIG. 3 is a section along lines 3—3 of FIG. 2.

As shown in FIG. 3 the guides 42*a* and 42*b* serve as a channeling means for deposit of the yarn directly on the surface of the fixation disc 41 and also serve to maintain the yarn on the disc long enough to fix the nodes. The disc can be driven by an electrical motor 43. Although FIG. 2 illustrates a wheel 25 having a single rotating fixation means 41, such wheel may be provided with a plurality of rotating fixation means distributed around the wheel, with the proviso that each fixation means be positioned to contact a node.

Figure 4:
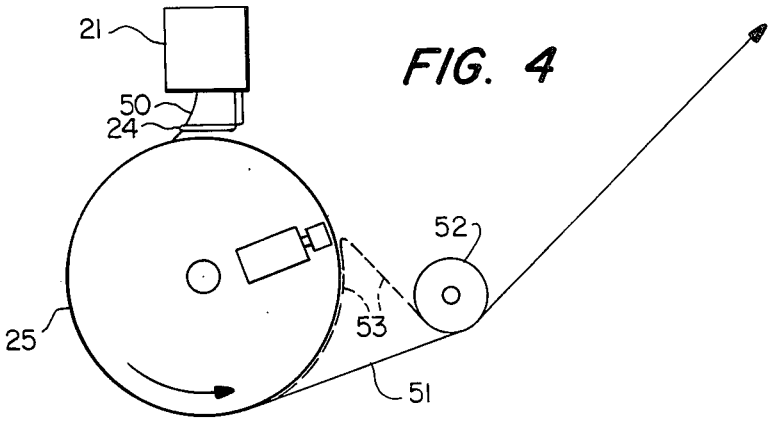
FIG. 4 is a side elevation schematically illustrating the yarn wheel of FIGS. 2 and 3 and related guide means.

FIG. 4 shows a side elevation of a yarn wheel, such as the wheel 25 of FIGS. 2 and 3 with a jet such as jet 21 and wire guide 24 to guide the yarn onto the wheel. A portion 50 of the yarn strand emerges from the jet 21, with twist inserted, and is guided around the yarn wheel, its node fastened, and follows the path indicated at 51 around a guide wheel 52 which referred to as a doffer roll. The yarn passes around only a portion of the doffer roll, normally, and proceeds either to the heat set apparatus and/or to apparatus for winding onto a storage package.

It is possible, however, for the yarn to become engaged on the fixation disc 41 and follow a path indicated generally at 53 by dashed lines, this being an undesirable event because it introduces additional tension into the yarn and can cause breakage. For this reason, it is desirable to provide the doffer roll to asure that the yarn follows the normal, desired path and does not become stuck on the yarn wheel.

Figure 5:
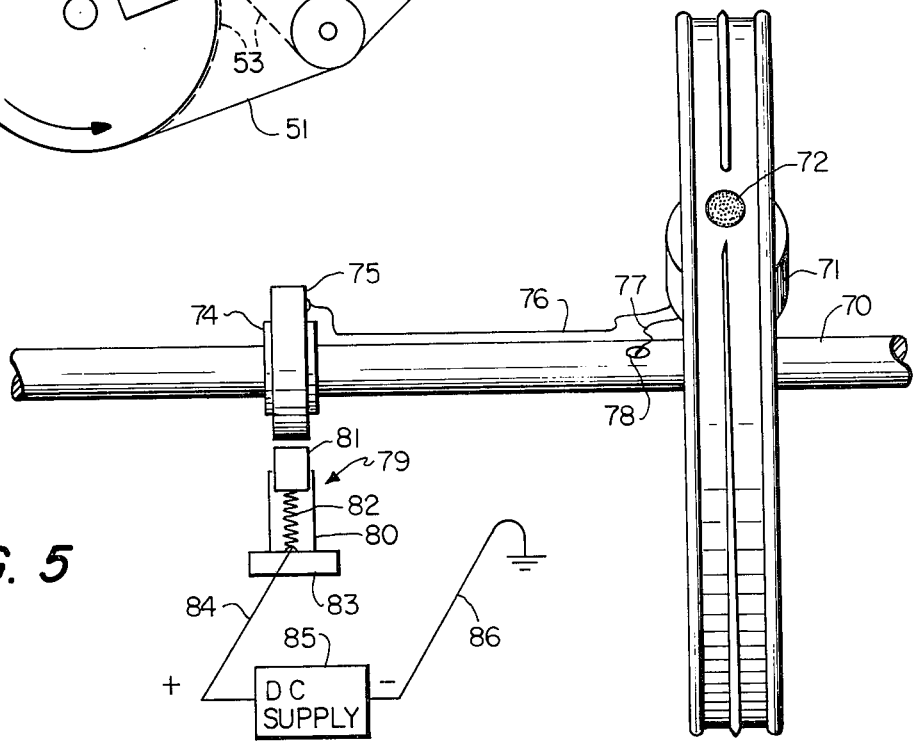
FIG. 5 is a schematic side elevation of a yarn wheel in accordance with the invention showing an arrangement of slip rings.

A suitable arrangement for providing power to a motor for driving the fixation disc is shown in FIG. 5. The yarn wheel 25 is fixedly mounted on a yarn wheel drive shaft 70 so that the wheel rotates with the shaft. A fixation disc drive motor 71 is mounted in wheel 25 so that its axis of rotation and its output shaft extend along a radius of wheel 25. An abrasion disc 72 is mounted on the distal end of the shaft of motor 71 so that energization of motor 71 causes disc 72 to rotate. While motor 71 can be an AC motor, a DC motor is preferred because the speed of the motor can then be made variable in a simple fashion by varying the magnitude of the DC supply.

Also, fixedly mounted on shaft 70 is an electrically nonconductive insulator bushing 74. An electrically conductive ring 75 is mounted on bushing 74 so that a conductive outer surface thereof is exposed. Ring 75 is electrically connected to one terminal of motor 71 by a wire 76, the other terminal of motor 71 being grounded by a wire 77 connected between the terminal and a convenient point on the frame of the apparatus such as a screw 78 on shaft 70.

A brush holder indicated generally at 79 is mounted on the mchine frame adjacent ring 75, the brush holder being conventional in nature and having a sleeve 80 within which a standard carbon brush or the like 81 is movable toward and away from the exposed conductive surface of ring 75. The brush 81 is urged toward ring 75 by a compression coil spring 82 which extends between brush 81 and a mounting base plate 83 on which sleeve 80 is mounted. A wire 84 is connected between brush 81 and one terminal of a source of DC voltage 85, the other terminal of source 85 being connected to ground as by a wire 86.

With this arrangement, ring 75 acts as a slip ring, brush 81 being in continuous electrical contact therewith to supply energizing power to motor 71. Source 85 can include conventional switching and control means to vary the magnitude of the voltage supplied.

Figure 6:
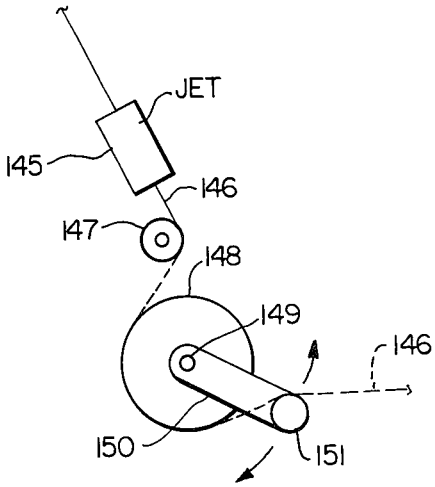
FIG. 6 is a side elevation, in schematic form, of a yarn wheel and doffing mechanism in accordance with the invention.

In any of the foregoing embodiments, the path of the yarn wheel can be made adjustable, particularly in connection with an embodiment in the nature of FIG. 4 by providing an adjustable doff roller. As illustrated schematically in FIG. 6, twist is inserted in the single yarns by a jet 145, the yarn 146 passing around a runner bowl or guiding means 147 and onto a yarn wheel 148 which is rotatable about a central axis 149. A lever arm 150 is also rotatably mounted on axle 149, the other end of the arm having an axle which supports a doffing roller 151. Thus, the yarn 146 is guided onto the yarn wheel, extends partially around the wheel, and then separates from the wheel and passes around doffing roller 151. As indicated in FIG. 6, the extent of travel of the yarn on the yarn wheel and therefore the time that the node is treated by the fixation device is adjustable by adjusting the angle of arm 150 about axis 149.

Figure 7:
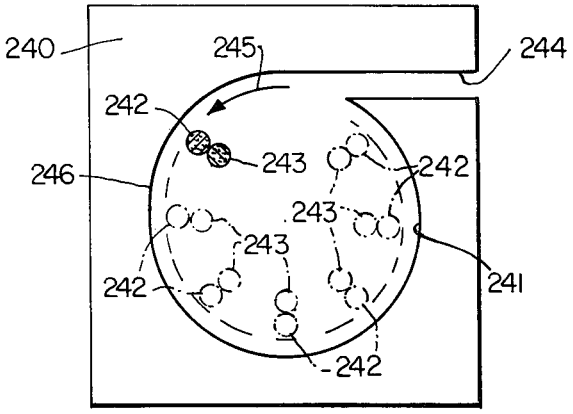
FIGS. 7 and 8 are schematic diagrams for explanation of yarn false-twisting phenomena.
Figure 8:
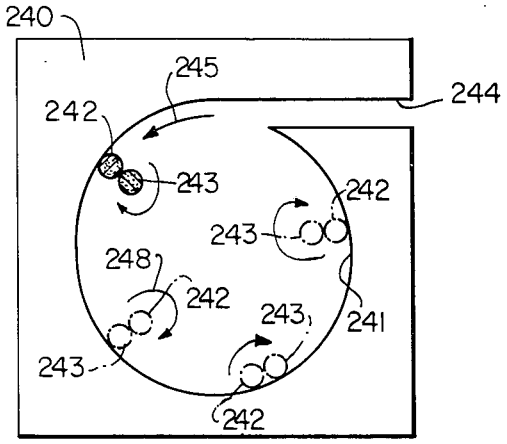

FIGS. 7–11 deal with an improved jet usable in the system of FIG. 1 and in conjunction with the yarn wheel apparatus of the other figures, to twist fibers of a singles yarn before locking and self-twisting. FIGS. 7 and 8 are explanatory schematic diagrams illustrating phenomena which occur in yarn twisting by pneumatic vortex jets under certain conditions. As illustrated in FIG. 7, a typical vortex jet can include a body 240 which is shown in cross-section in FIG. 8, the body having an elongated central bore 241 through which the yarn passes. It will be assumed that the yarn in the device of FIG. 8 passes longitudinally through the bore in the direction emerging from the paper. The yarn is schematically indicated as including individual filaments or fibers 242 and 243, these being depicted somewhat enlarged for clarity of explanation. An air inlet conduit 244 enters the body and communicates tangentially at one side of the central bore 241, causing a rotating stream of air within bore 241 in the direction of arrow 245. Commonly, inlets such as 244 do not enter body 240 in a direction perpendicular to the surface through which it enters, but, instead, is slanted slightly so that in addition to having a circular motion the vortex within bore 241 also as an axial component in the direction of yarn movement, the air from the vortex being simply permitted to emerge at the outlet end of the jet device.

Depending upon yarn strand tension and other factors, a layer or film of air 246 is produced such that the singles yarns 242 and 243 do not contact the inner surface of bore 241. Instead, the strands are caused to whip around the interior of the bore without contacting the bore walls in "jump rope" fashion.

It can be seen that for each complete revolution of the yarn unit around the bore, one turn of twist is developed on each side of the vortex plane. These twists are opposite so that, for a given jet configuration, an S twist is made on one side of the vortex plane whenever a Z twist is generated on the other.

This circumstance persists only so long as the yarn tension is sufficiently high to prevent the yarn arc from penetrating the film and touching the wall of the yarn bore in the jet.

However, if the tension decreases, the phenomenon of "gearing" begins and a higher twist occurs but in the reverse direction. This is illustrated in FIG. 8 wherein the same device with the same vortex direction is provided but wherein the tension has decreased to the point where the yarn rolls around the interior of the bore. Gearing occurs when either yarn tension is low enough to allow contact with the bore surface or when the jet orifice is slightly less than tangential or, obviously, when both conditions exist. More than one turn of twist is inserted per revolution of the yarn around the bore wall when gearing exists, the turns of twist per revolution being equal to the circumference of the yarn bore divided by the average circumference of the yarn, this ratio being multiplied by an efficiency or slippage factor less than 1.00 which is a function of yarn tension, air pressure and friction between the yarn and tube wall.

As thread line tension increases, as it will because twist is being inserted and the yarn is contracting, the yarn strand contacts the wall of the bore less intimately. Thus, the slippage factor is increased and the twist insertion rate is reduced, causing extreme variations in yarn twists. This disadvantage is accompanied by the more severe disadvantage that yarn tensions can easily become so high that yarn is drawn out of contact with the tube wall in which case filming begins and the twist is reversed. The tension and yarn count related twist variations and inadvertent reversals of twist can be overcome if it can be assured that the twist insertion jet acts in the filming mode at all times because one complete swing of the yarn arc equals one turn of twist regardless of the perimeter in which the arc swings.

Figure 11:
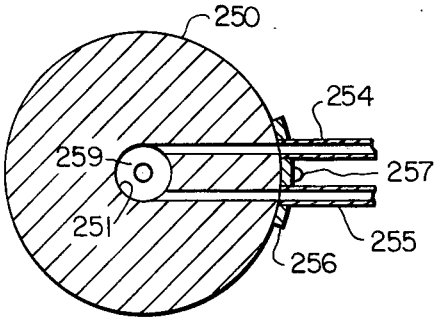
FIG. 11 is a sectional view along lines 11—11 of FIG. 9.
Figure 9:
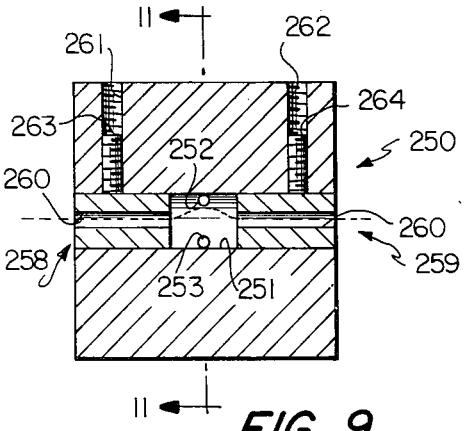
FIG. 9 is a side elevation, in section of a false-twisting vortex jet device usable in the system of FIG. 1.
Figure 10:
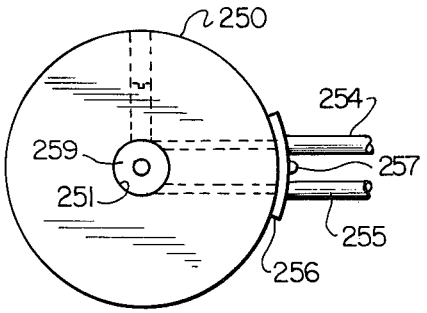
FIG. 10 is an end elevation of the device of FIG. 9.

From this, it will be seen that it is highly desirable to produce a device which completely avoids the gearing phenomenon, to which end the apparatus of FIGS. 9–11 is directed.

As shown therein, the jet includes a body 250 having a central bore 251 with tangential orifices 252 and 253 intersecting the bore at diametrically opposite sides thereof. Two such jet inlets are provided to permit control of twist in either direction, as by alternately supplying the orifices with air under pressure. Air is supplied through conduits 254 or 255, which conduits are held in place by mounting means such as a plate 256 to which the conduits are attached, the plate being attached to the jet as by screws or similar fastening means 257.

Annular inserts 258 and 259 are provided at opposite ends of bore 251, each insert having an outer diameter equal to the inner diameter of the bore so that the inserts are slidably received therein. Each insert has an interior axial bore 260 of a smaller size than the bore 251, bores 260 being of a suitable size to permit the yarn to longitudinally pass therethrough. Body 250 is provided with internally threaded radially extending bores 261 and 262 which receive set screws 263 and 264, respectively. Bores 261 and 262 extend from the outer surface of the body into bore 251 so that, when inserts 258 and 259 are present, the set screws engage the inserts and hold them in place. Thus, for any given set of circumstances, the inserts can be axially adjusted and then locked in place using the set screws.

By adjustment of the inserts inwardly toward the jet orifices, a position can be established at and beyond which the jet will operate in a filming mode on a particular yarn size, substantially regardless of the tension of the thread line. This is due to the fact that the jet orifices are always effectively outside the yarn arc turning radius, the air film resulting from the orifices being recessed radially beyond the insert bores producing a thicker air film. With this structure, the tangential relationship of the orifices 252 and 253 relative to bore 251 is not nearly so critical as in conventional vortex jets. However, it is preferred that the orifices be tangential to bore 251. Jets fabricated as described have been known to develop the same direction twist in yarns with no tension whatsoever and on those strained almost to the point of breakage.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for forming a self-twist plural strand yarn comprising means for forming at least two singles yarn strands;

means for twisting each of said strands individually to form twisted strands each having longitudinally spaced nodes at which the direction of twist reverses;

means for guiding and carrying said strands into closely spaced substantially parallel paths with the nodes of one strand substantially aligned with the nodes of each other strand; and means for fastening each of said strands together at said nodes and for self-twist plying of the strands between said nodes, and wherein said means for guiding and carrying comprises a rotatable guide member, and said means for node fastening includes rotating contact means carried by said rotatable guide member, said contact means being exposed to said yarn paths at spaced intervals for fixing said strands together at the regions of said nodes.

2. An apparatus according to claim 1 wherein said rotating contact means rotates about an axis different from the axis of rotation of said rotatable guide member.

3. An apparatus according to claim 2 wherein said rotatable guide member includes a rotatable generally disc-shaped member having a peripheral surface and a separatory radial flange thereon for defining separate guide paths for each of said strands;

means for causing said strands to lie along said peripheral surface over a predetermined portion of said member; and means defining an opening in said flange for permitting said strands to be brought into contact with each other at the location of the rotating contacting means.

4. An apparatus according to claim 3 wherein said rotatable guide member further includes means in said peripheral surface defining an aperture;

and said contact means includes a rotatable abrasive surface in said aperture, said abrasive surface lying in said guide paths, and means for rotating said abrasive surface about an axis which is substantially perpendicular to the axis of rotation of said rotatable guide member.

5. An apparatus according to claim 4 wherein said means for rotating includes an electrical motor carried by said rotatable guide member and having an output shaft coupled to said contact means.

6. An apparatus according to claim 5 and further comprising a source of electrical energy; and circuit means including slip ring means for providing electrical energy from said source to said motor while said contact means is rotating.

7. An apparatus according to claim 3 and further comprising means for rotating said contact means including an electrical motor;

a source of electrical energy; and circuit means including slip ring means for providing electrical energy from said source to said motor while said contact member is rotating.

8. An apparatus according to claim 7 wherein said source of electrical energy is a DC source including means for adjusting the magnitude of DC energy supplied to said motor to adjust motor speed.

9. An apparatus according to claim 3 wherein said means for guiding includes a freely rotatable guide wheel having a central annular depression to receive the plied yarn;

means for mounting said guide wheel for rotation about an axis parallel with the axis of rotation of said disc-shaped member and for translating the axis of rotation of said guide wheel to adjust the point from which the yarn leaves said member.

10. An apparatus according to claim 9 wherein the peripheral surface of said disc-shaped member is circular.

11. An apparatus according to claim 2 and further comprising means for heat-setting the plied yarn.

12. An apparatus according to claim 3 wherein said rotatable guide member further includes second and third radial flanges axially separated from said separating flange by said guide paths.

13. An apparatus according to claim 12 wherein said rotatable guide member futher includes means extending inwardly from said second and third flanges toward said opening in said separating flange for guiding said strands to said rotating contact means.

* * * * *